US005459292A

United States Patent [19]

Nagano et al.

[11] Patent Number: 5,459,292

[45] Date of Patent: Oct. 17, 1995

[54] JOYSTICK OPERATED, SELECTIVELY ACTUATED, PLURAL SWITCH ARRAY

[75] Inventors: Hiroyuki Nagano, Yamatotakada; Yasuji Shibano, Izumisano, both of Japan

[73] Assignee: Hosiden Corporation, Yao, Japan

[21] Appl. No.: 123,045

[22] Filed: Sep. 20, 1993

[30] Foreign Application Priority Data

Nov. 12, 1992 [JP] Japan ..... 4-077921 U

[51] Int. Cl.[6] ..... H01H 9/00; H01H 15/00; H01H 25/04

[52] U.S. Cl. ..... 200/5 R; 200/4; 200/6 A; 200/16 D; 200/18

[58] Field of Search ..... 200/4, 5 R, 6 A, 200/16 C, 16 D, 5 A, 18; H01H 1/00, 9/00, 25/00, 25/04

[56] References Cited

U.S. PATENT DOCUMENTS

| | | | |
|---|---|---|---|
| 2,841,659 | 7/1958 | Eitel | 200/6 A X |
| 3,030,459 | 4/1962 | Elliott et al. | 200/6 A |
| 4,041,258 | 8/1977 | Harada | 200/6 A |
| 4,245,137 | 1/1981 | Hirai et al. | 200/4 |
| 4,330,694 | 5/1982 | Ogawa | 200/6 A |
| 5,047,596 | 9/1991 | Ebishi | 200/4 |

FOREIGN PATENT DOCUMENTS

| | | | |
|---|---|---|---|
| 59-25075 | 7/1984 | Japan | H01H 25/04 |

*Primary Examiner*—J. R. Scott
*Attorney, Agent, or Firm*—Jones, Tullar & Cooper

[57] ABSTRACT

The control switch according to the present invention provides different electric conduction states and may be used for setting a point indicated by a cursor on a monitor in a navigation system. The control switch comprises (i) two terminal members each having four terminals, and (ii) common terminals respectively corresponding to the two terminal members. One terminal member is different in phase from the other terminal member. When one common terminal and its terminal member are short-circuited by a movable contact-piece member, the other common terminal and its terminal member are in a non-conduction state. When the common terminal and its terminal member are short-circuited by a movable contact-piece member, the one common terminal and its terminal member are in a state of non-conduction.

12 Claims, 8 Drawing Sheets

JOYSTICK OPERATED, SELECTIVELY ACTUATED, PLURAL SWITCH ARRAY

BACKGROUND OF THE INVENTION

1. Field of the Invention

The present invention relates to a control switch, and more particularly to a control switch having an operating mechanism comprising an operating lever arranged such that, by swinging or turning the operating mechanism, there are provided different states of electric conduction. Such a control switch can be used as a control switch in a navigation system.

A navigation system mounted on a motor vehicle is required to have not only a function of moving a point indicated by the cursor on a monitor in the X-axis direction and the Y-axis direction at a right angle thereto, but also a function of moving such a point in oblique directions between the X- and Y-axis directions. The navigation system is also required to have a function of setting the point position to which the cursor has been moved.

The control switch of the present invention satisfies the requirements mentioned above.

2. Description of the Prior Art

Japanese Utility Model Publication No. 59-25075 discloses a control switch in which the operating lever can be swung and turned so that any of different states of electric conduction is provided dependent on the position to which the operating lever is set. This control switch may be used, for example, for setting any of the states of electric conduction where motors are to be reversely and forwardly rotated. Further, this control switch provides four different states of electric conduction and can therefore be used as a switch for controlling any of the positions of the fender mirrors of a motor vehicle.

It may be considered to apply the control switch discussed in the publication above-mentioned, to a switch for controlling the moving direction of a point indicated by the cursor on the monitor in a navigation system. However, this control switch can provide only four different states of conduction. Accordingly, when such four different states of conduction are respectively used for setting a point in the X- and Y-axis directions at the positive and nevative sides, it is not possible to provide four different states of conduction for setting a point in diagonal directions at the positive and negative sides. Further, this control switch is not provided with a function of setting the point position to which the cursor has been moved on the monitor.

SUMMARY OF THE INVENTION

In view of the foregoing, the present invention is proposed with the object of providing a control switch capable of providing a number of electric conduction state which could never be obtained merely by following the technology of the control switch disclosed in Japanese Utility Model Publication No. 59-25075.

It is another object of the present invention to provide a control switch arranged such that, by swinging and turning the operating lever, there can be provided not only four different states of electric conduction in the X- and Y-axis directions, but also four different states of electric conduction in diagonal directions.

It is a further object of the present invention to provide a control switch having a very simple structure.

It is still another object of the present invention to provide a control switch in which a switching operation can be carried out.

It is a still further object of the present invention to provide a thin control switch.

To achieve the objects mentioned above, the present invention provides a control switch comprising: a base; a movable body disposed on the base slidably in all directions and normally biased toward a neutral position of the base; an operating mechanism for sliding the movable body in all directions; a first terminal member disposed on the surface of the base and having a terminal pattern which presents (i) an electric insulating portion at the center portion of the first terminal member, (ii) a plurality of electric insulating portions around the center portion mentioned above at regular angular intervals and (iii) a plurality of terminals as divided by the electric insulating portions; a second terminal member disposed on the surface of the base and having a terminal pattern which presents (i) an electric insulating portion at the center portion of the second terminal member, (ii) a plurality of electric insulating portions around the center portion mentioned above at regular angular intervals and (iii) a plurality of terminals as divided by the electric insulating portions, the terminal pattern being different in phase from the terminal pattern of the first terminal member; a first common terminal disposed on the surface of the base, the first common terminal corresponding to the first terminal member; a second common terminal disposed on the surface of the base, the second common terminal corresponding to the second terminal member; a first movable contact-piece member adapted to be set at (i) a position where the first movable contact-piece member extends over the electric insulating portion of the first terminal member at the center portion thereof and the first common terminal when the movable body is set to the neutral position, and (ii) a position where the first movable contact-piece member extends over one of the terminals of the first terminal member and the first common terminal when the movable body is slided in a direction away from the neutral position; and a second movable contact-piece member adapted to be set at (i) a position where the second movable contact-piece member extends over the electric insulating portion of the second terminal member at the center portion thereof and the second common terminal when the movable body is set to the neutral position, and (ii) a position where the second movable contact-piece member extends over one of the terminals of the second terminal member and the second common terminal when the movable body is slid in a direction away from the neutral position.

According to the present invention, the first and second terminal members may be formed such that each of the terminal patterns thereof presents four terminals and five electric insulating portions, and that the terminal patterns may be different in phase by 45° from each other. Further, the movable body may be set to the neutral position on the base by the biasing forces of resilient members each comprising a compression coiled spring.

According to the control switch having the arrangement mentioned above, when the movable body is set to the neutral position, (i) the first movable contact-piece member is set at a position where the first movable contact-piece member extends over the electric insulating portion of the first terminal member at the center portion thereof and the first common terminal, so that the first common terminal and the first terminal member are maintained in a state of non-conduction, and (ii) the second movable contact-piece member is set at a position where the second movable contact-piece member extends over the electric insulating portion of the second terminal member at the center portion thereof and the second common terminal, so that the second common terminal and the second terminal member are maintained in a state of non-conduction.

The terminal patterns of the first and second terminal members are different in phase from each other. Accordingly, when the movable body is slid on the base by the operating mechanism, the first and second movable contact-piece members are moved according to a direction in which the movable body is slid. When the first movable contact-piece member is set at a position where the first movable contact-piece member extends over one of the terminals of the first terminal member and the first common terminal, the second movable contact-piece member is set at a position where the second movable contact-piece member extends over one of the electric insulating portions of the second terminal member and the second common terminal. When the first movable contact-piece member is set at a position where the first movable contact-piece member extends over one of the electric insulating portions of the first terminal member and the first common terminal, the second movable contact-piece member is set at a position where the second movable contact-piece member extends over one of the terminals of the second terminal member and the second common terminal. Accordingly, each of the electric conduction states obtained by connecting the first common terminal to each of the terminals of the first terminal member, can be used for moving the cursor in each of the X- and Y-axis directions at the positive and negative sides on the monitor, and each of the electric conduction states obtained by connecting the second common terminal to each of the terminals of the second terminal member, can be used for moving the cursor in diagonal (upward-rightward and downward-rightward) directions at the positive and negative sides on the monitor. Thus, there can be provided eight different electric conduction states.

Thus, the control switch according to the present invention can advantageously provide a number of different electric conduction states readily and securely. Further, in the present invention, ingenuity is exercised only on the terminal patterns of the first and second terminal members. Further, only two (first and second) movable contact-piece members are used. Accordingly, the present invention is advantageous in that the structure is very simple and the number of required component elements such as the movable contact-piece members is not excessively increased.

According to the present invention, the operating mechanism may be formed by a spherical body and an operating lever projecting from the spherical body. Further, the spherical body may be held by a case-like holding body disposed at the center portion of the base such that the spherical body is rotatable and slidable in the axial direction of the holding body. Further, the holding body may have a switch having an actuator adapted to be operated by the spherical body when the spherical body is displaced in the axial direction of the holding body.

According to the control switch having the arrangement mentioned above, by moving the operating lever in the axial direction of the holding body, the spherical body can operate the actuator of the switch and the switch can be switched regardless of the position to which the movable body is slid on the base. Accordingly, when the control switch of the present invention is used in a navigation system, there can be rapidly and securely carried out with good maneuverability, (i) an operation of optionally moving a point indicated by the cursor in any of the X-axis, Y-axis and diagonal directions on the monitor, and (ii) an operation of immediately setting the point position to which the cursor has been moved.

When the spherical body of the operating mechanism is fitted in the holding body such that the spherical body cannot be rotatable on its own axis, the operating lever is not rotatable on its own axis regardless of the position to which the operating lever has been moved. Accordingly, a variety of conduction states in the X-axis, Y-axis and diagonal directions can be effected by on the operating lever. This improves maneuverability.

DETAILED DESCRIPTION OF THE PREFERRED EMBODIMENT

As shown in FIGS. 1 to 5, a control switch according to an embodiment of the present invention has a box-shaped body 1, of which the bottom wall also serves as a base 2 which is square in plan elevation. Four lateral walls 11 of the box-shaped body 1 integrally stand from the four sides of the base 2.

Figure 2:
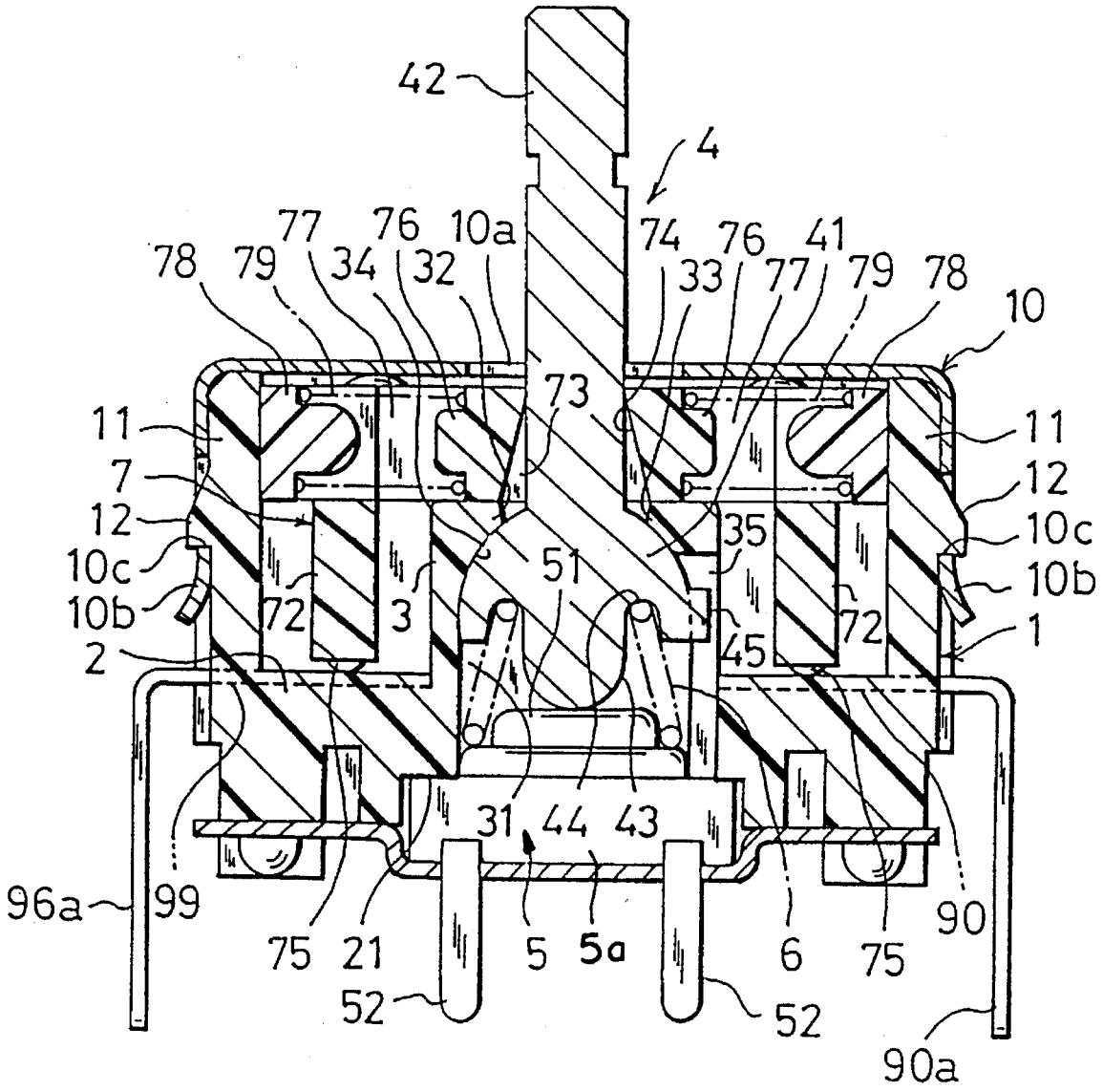
FIG. 2 is a section view taken along the line II—II in FIG. 1.

A holding body 3 integrally extends from the base 2 at the center portion thereof. The holding body 3 may be rectangular or circular in plan elevation, and is made in the form of a casing. In this embodiment, the holding body 3 is a rectangular casing. As shown in FIG. 2, the holding body 3 is provided at the upper part of the inside thereof with an expanding portion 32 which projects toward the inside of the holding body 3 from the outer peripheral side thereof. In the expanding portion 32, the inner peripheral surface of the upper part thereof is made in the form of a conical surface 33 which flares in the upward direction, and the inner peripheral surface of the lower part is made in the form of a spherical surface 34 which smoothly communicates with the cylindrical wall surface of a through-hole 31 in the holding body 3.

An operating mechanism 4 has a spherical body 41 and an operating lever 42. The spherical body 41 is held in the through-hole 31 in the holding body 3 so as to be slidable and displaceable to a predetermined limited range in the axial direction of the holding body 3. The operating lever 42 projects from the spherical body 41 in the upward direction of the holding body 3. The diameter of the spherical body 41 is greater than the smallest inner diameter of the expanding portion 32. The spherical body 41 has a downwardly projecting portion 43 and a concave spring seat 44 therearound. The spherical body 41 has a transversely projecting portion 45. The transversely projecting portion 45 is fitted in a slit-like engagement hole 35 which is formed in the holding body 3 and which extends in the axial direction thereof. The transversely projecting portion 45 is slidable in the hole 35 only in the axial direction of the holding body 3. According to the arrangement mentioned above, the spherical body 41 is slidable in the axial direction of the holding body 3 but is not rotatable on its own axis in the holding body 3.

The base 2 is provided in the center portion thereof with a concave recess 21. A switch 5 is fitted in and held by the concave recess 21. As the switch 5, there is used a key switch which uses an inverting plate (not shown) also serving as a contact. A pushbutton 51 serving as an actuator projects inside of the through-hole 31 in the holding body 3. The pushbutton 51 is normally biased in the projecting direction by the spring force of the inverting plate. A compression coiled spring 6 is disposed between the spring seat 44 of the spherical body 41 and the housing 5*a* of the switch 5. The biasing force of the compression coiled spring 6 slidably pushes the surface of the spherical body 41 against the spherical surface 34 of the expanding portion 32. Accordingly, the spherical body 41 is engaged with the expanding portion 32. The compression coiled spring 6 may not be used. Instead, provision may be made such that the surface of the spherical body 41 is slidably pushed against the spherical surface 34 of the expanding portion 32 by the spring force of the inverting plate of the switch 5, this spring force being exerted against the pushbutton 51 coming in contact with the projecting portion 43 of the spherical body 41. When the pushbutton 51 is pushed, the switch 5 is turned on. When the pushbutton pushing force is released, the pushbutton 51 is reset so that the switch 5 is turned off. The switch 5 has terminals 52.

A movable body 7 has a square top plate 71 and lateral plates 72 downwardly extending from the four sides of the top plate 71, thus causing the movable body 7 to be made in the form of a box. The top plate 71 is provided in the center thereof with a through-hole 73 having a wall surface 74 which is downwardly outwardly inclined. The lateral plates 72 have projections 75 at the lower end surfaces at the corner portions thereof. Such a movable body 7 is disposed on the base 2 with the operating lever 42 axially slidably fitted in the through-hole 73. When the movable body 7 is slid on the base 2, the projections 75 are also slid on the surface of the base 2, enabling the movable body 7 to be smoothly slided.

Figure 1:
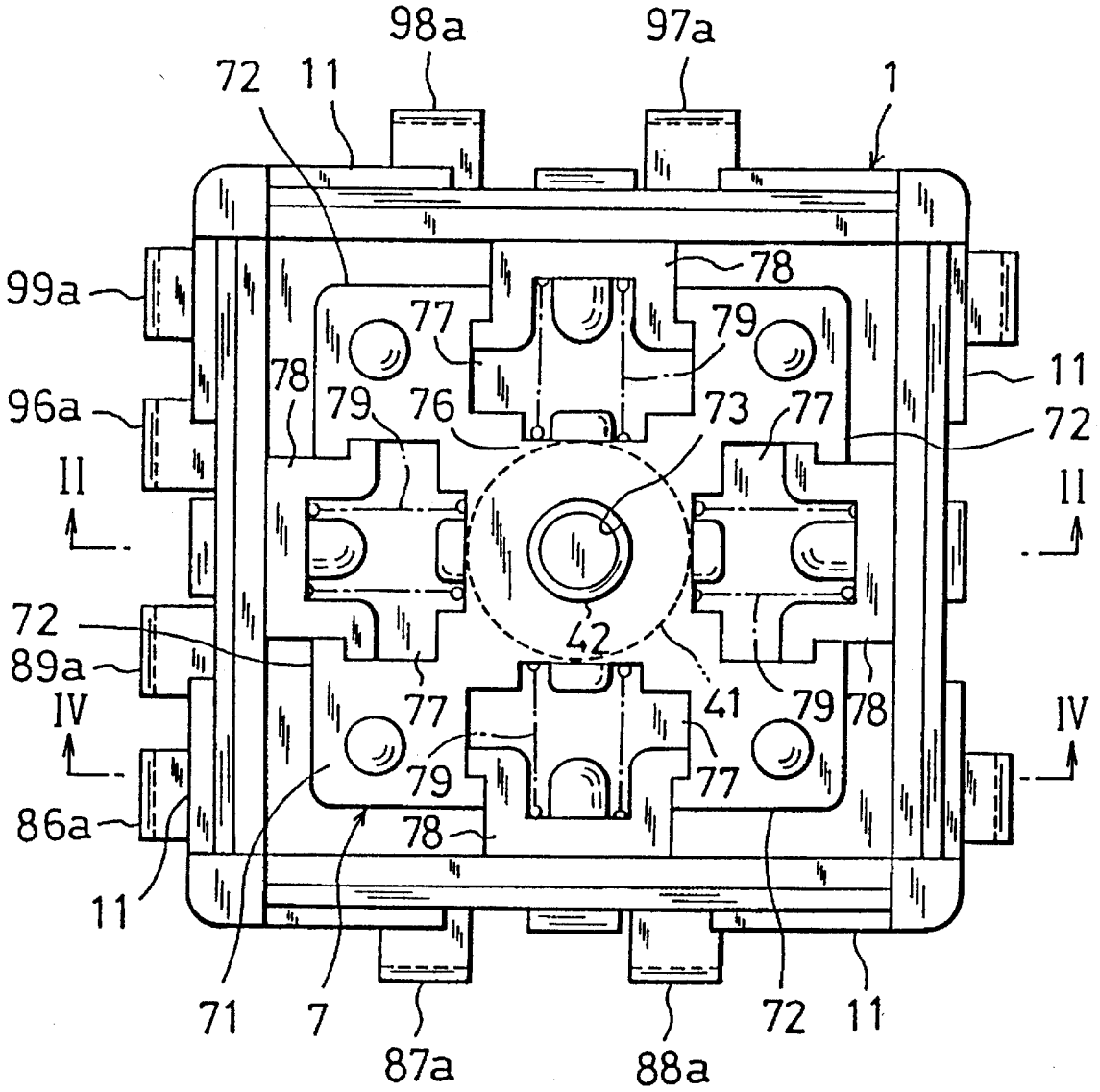
FIG. 1 is a plan view of a control switch according to an embodiment of the present invention with an upper cover removed.

As shown in FIGS. 1 and 2, the top plate 71 of the movable body 7 is provided in the center of each of the four sides thereof with a concave opening 77 having a spring seat 76. A spring receiving piece 78 is housed in each concave 77. A compression coiled spring 79 is disposed between each spring receiving piece 78 and each spring seat 76. The biasing forces of the compression coiled springs 79 cause the spring receiving pieces 78 to slidably come in contact with the lateral walls 11 of the box-shape body 1. Accordingly, the movable body 7 is normally biased toward the center (neutral) position of the base 2 by the cooperation of the four compression coiled springs 79.

Figure 3:
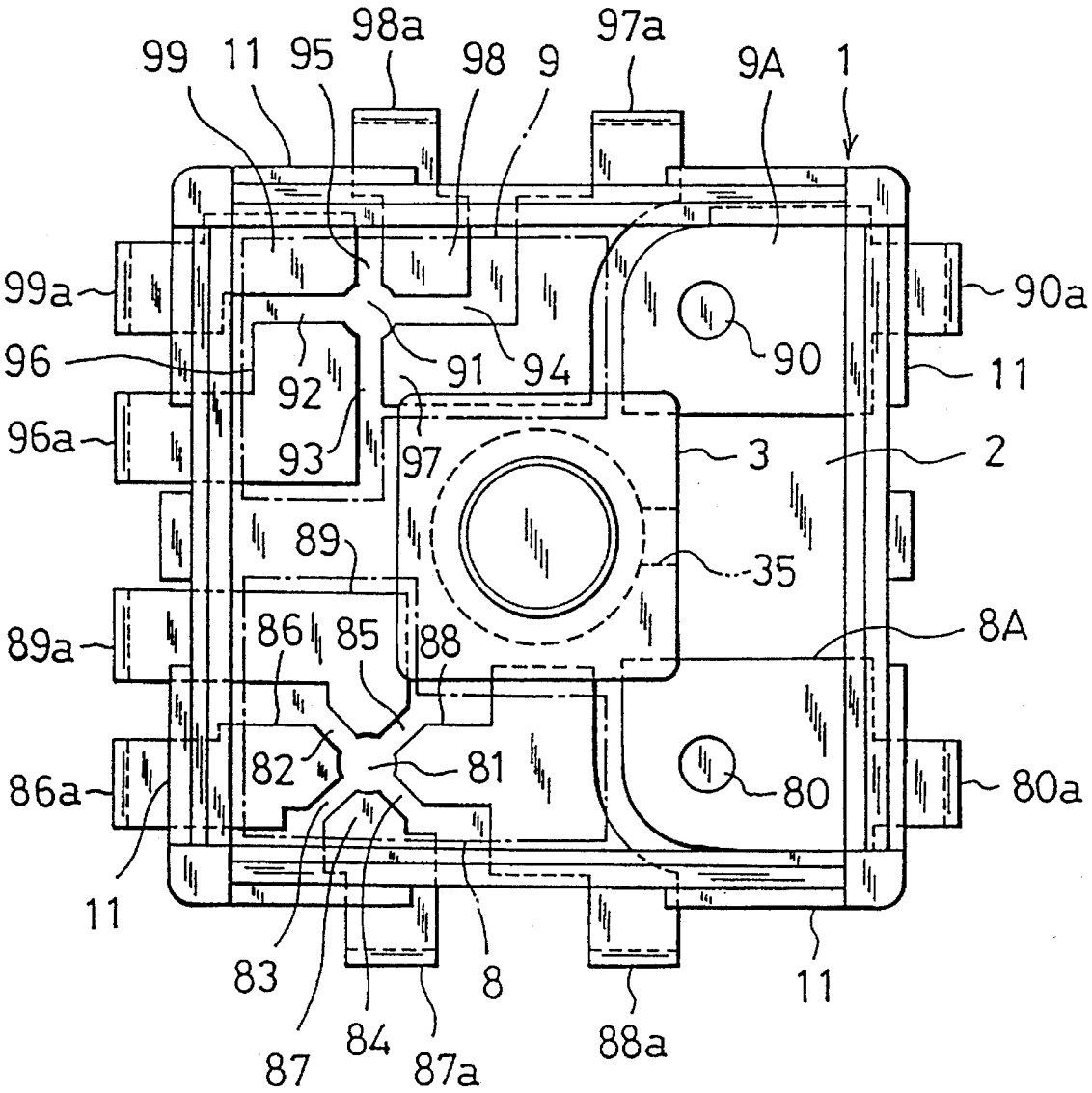
FIG. 3 is a plan view of a box-shaped body having a base having two common terminals and two terminal members.

As shown in FIG. 3, the base 2 is provided on the surface at one side thereof with a first terminal member 8 and a first common terminal 8A, and is also provided on the surface at the other side thereof with a second terminal member 9 and a second common terminal 9A. These terminal members 8, 9 and terminals 8A, 9A are embedded in the base 2 and flush with the surface of the base 2. The first terminal member 8 has an electric insulating portion 81 at the center portion thereof, and four electric insulating portions 82, 83, 84, 85 around the center portion thereof at regular angular intervals of 90°. Thus, the first terminal member 8 has a terminal pattern presenting four flat terminals 86, 87, 88, 89 as divided by these electric insulating portions 81 to 85. On the other hand, the first common terminal 8A has one electric insulating portion 80. The second terminal member 9 has an electric insulating portion 91 at the center portion thereof, and four electric insulating portions 92, 93, 94, 95 around the center portion thereof at regular angular intervals of 90°. Thus, the second terminal member 9 has a terminal pattern presenting four flat terminals 96, 97, 98, 99 divided by these electric insulating portions 91 to 95. On the other hand, the first common terminal 9A has one electric insulating portion 90. The terminal pattern of the first terminal member 8 is identical in arrangement with that of the second terminal member 9. However, the terminal pattern of the first terminal member 8 is different in phase by 45° from that of the second terminal member 9. In this embodiment, the electric insulating portions 81 to 85 of the first terminal member 8, the electric insulating portion 80 of the first common terminal 8A, the electric insulating portions 91 to 95 of the second terminal member 9 and the electric insulating portion 90 of the second common terminal 9A, are formed by the base 2 molded with the use of a synthetic resin excellent in electric insulating properties. There are also disposed lead terminals 86*a*, 87*a*, 88*a*, 89*a*, 96*a*, 97*a*, 98*a*, 99*a*, 80*a*, 90*a*.

Figure 4:
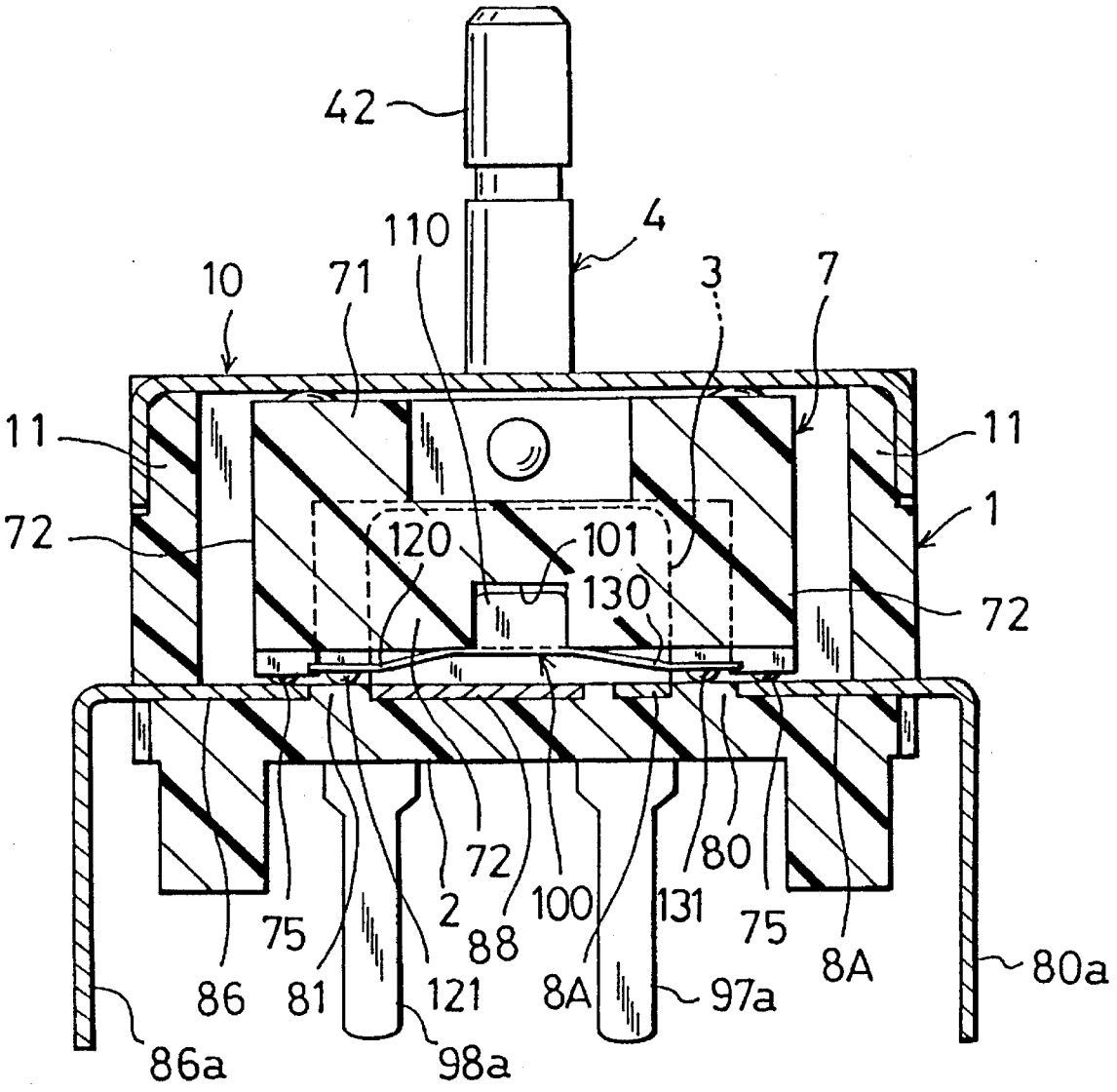
FIG. 4 is a section view taken along the line IV—IV in FIG. 1.
Figure 6:
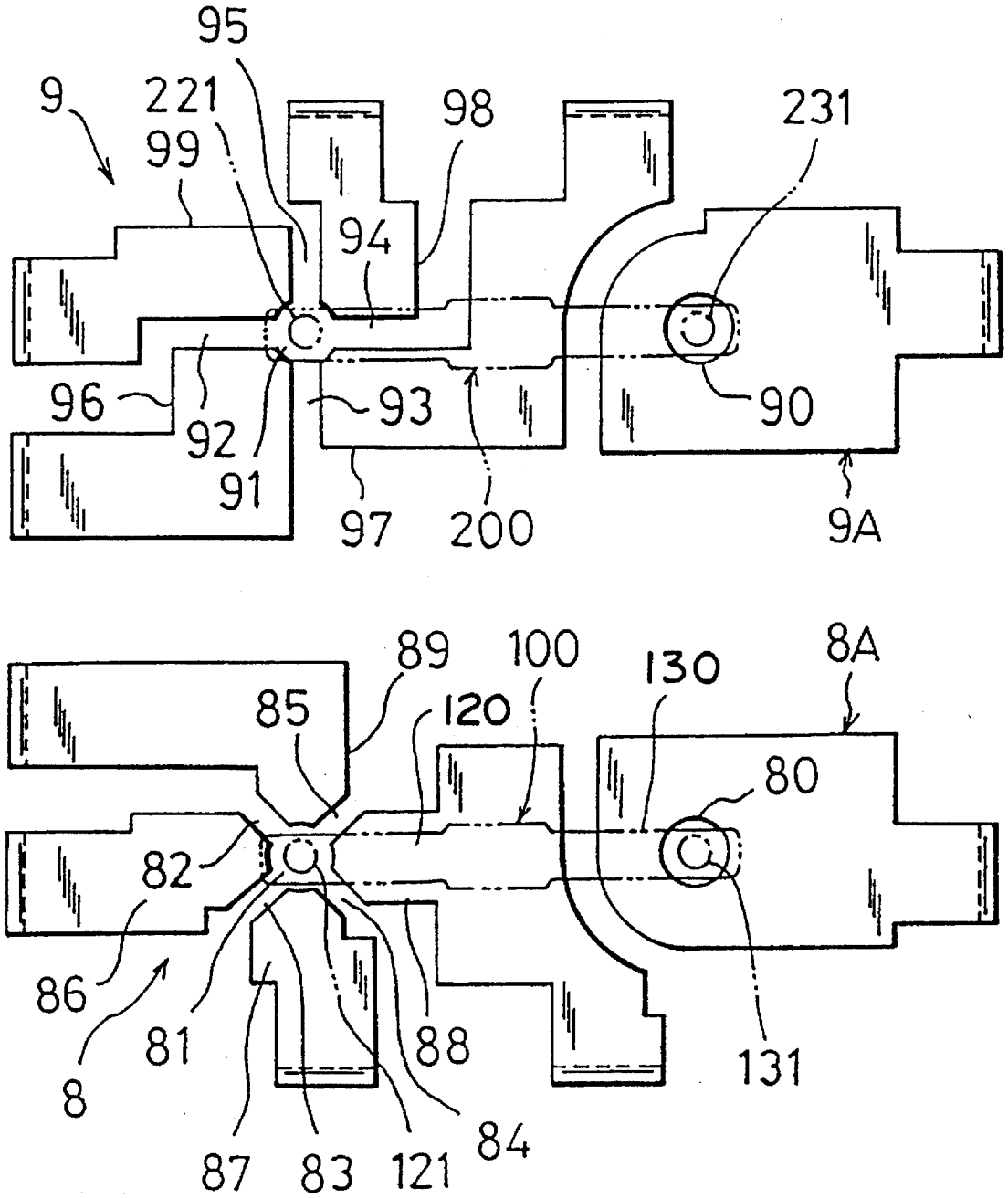
FIG. 6 is a view illustrating portions of the control switch in FIG. 1 when a movable body is set to a neutral position.
Figure 7:
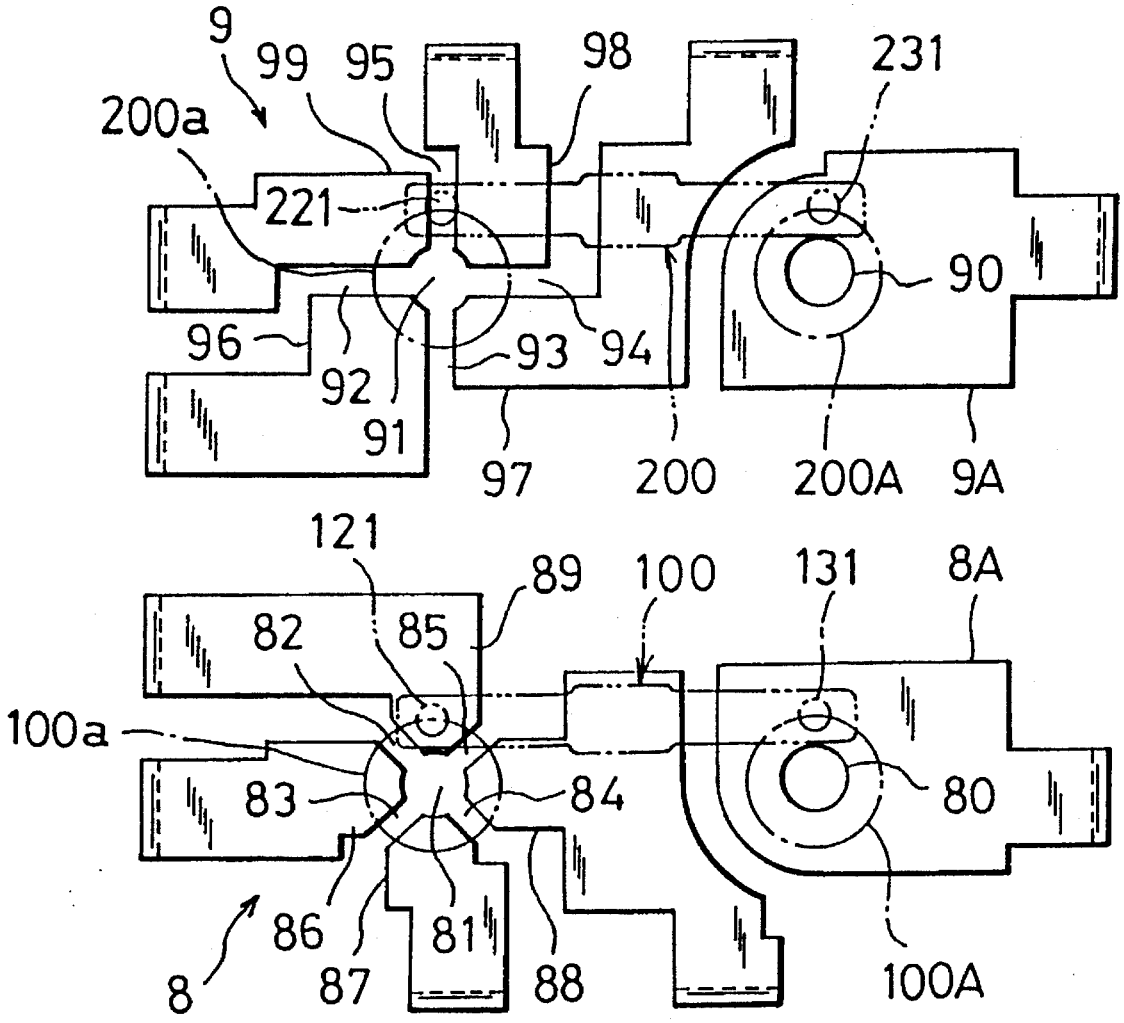
FIG. 7 is a view illustrating portions of the control switch in FIG. 1 when the movable body is slid in the upward direction on the drawing plane of FIG. 1.
Figure 8:
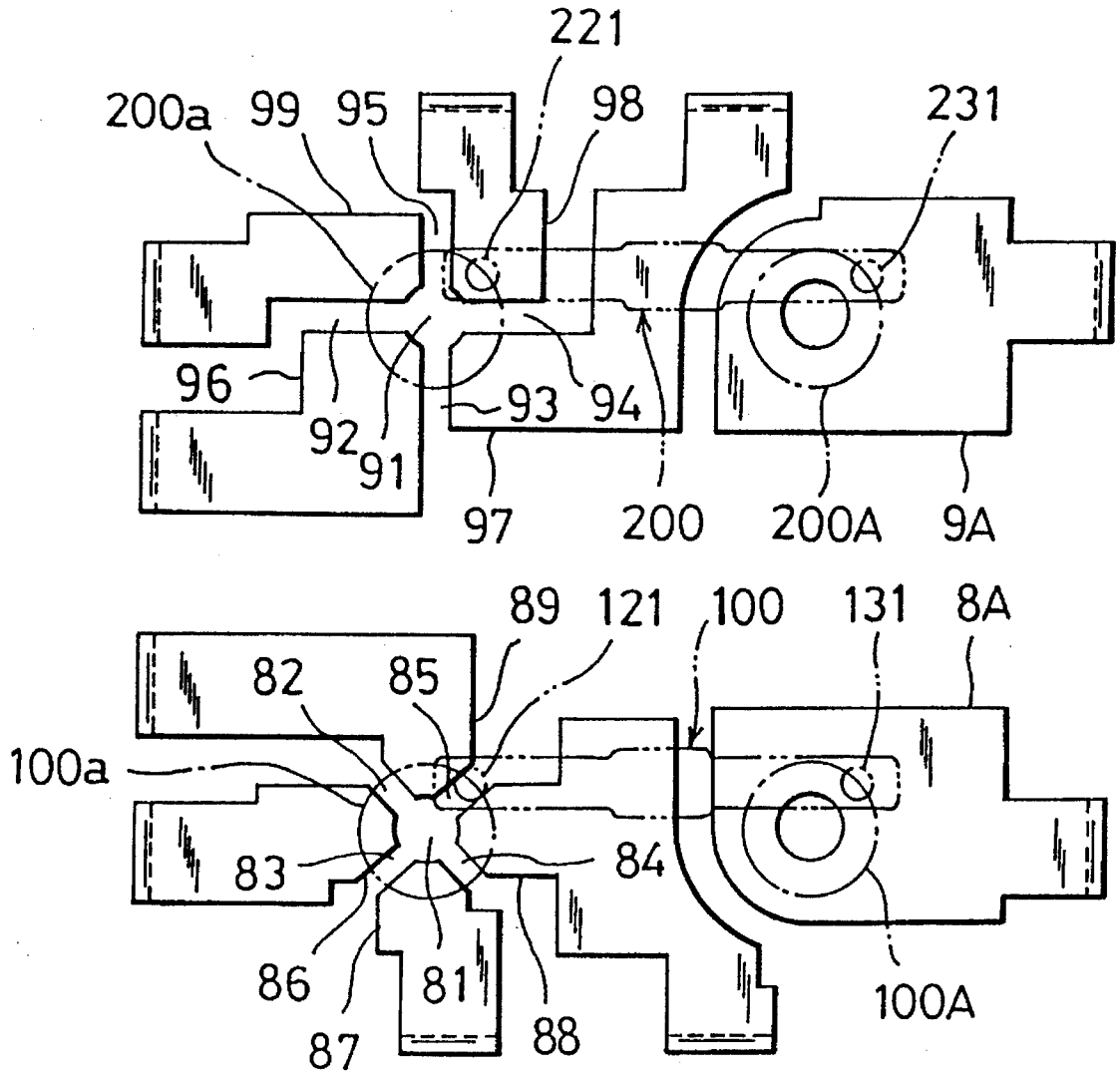
FIG. 8 is a view illustrating portions of the control switch in FIG. 1 when the movable body is slid in a diagonal direction on the drawing plane of FIG. 1.

A first movable contact-piece member 100 and a second movable contact-piece member 200 (See FIG. 4 and FIGS. 6 to 8) are respectively disposed at the undersides of two opposite lateral plates 72 of the movable body 7. As shown in FIG. 4, the first movable contact-piece member 100 has an attachment plate portion 110, a pair of contact pieces 120, 130 extending to both sides of the attachment plate portion 110, and contacts 121, 131 respectively disposed at the ends of the contact pieces 120, 130. The attachment plate portion 110 is received in a concave opening 101 formed in the center of the lateral plate 72 of the movable body 7. As shown in FIGS. 6 to 8, the pair of contact pieces 120, 130 are so disposed as to extend over the first terminal member 8 and the first common terminal 8A. The second movable contact-piece member 200 is not shown in FIG. 4, but has the same arrangement as that of the first movable contact-piece member 100 and is so disposed as to extend over the second terminal member 9 and the second common terminal 9A.

Figure 5:
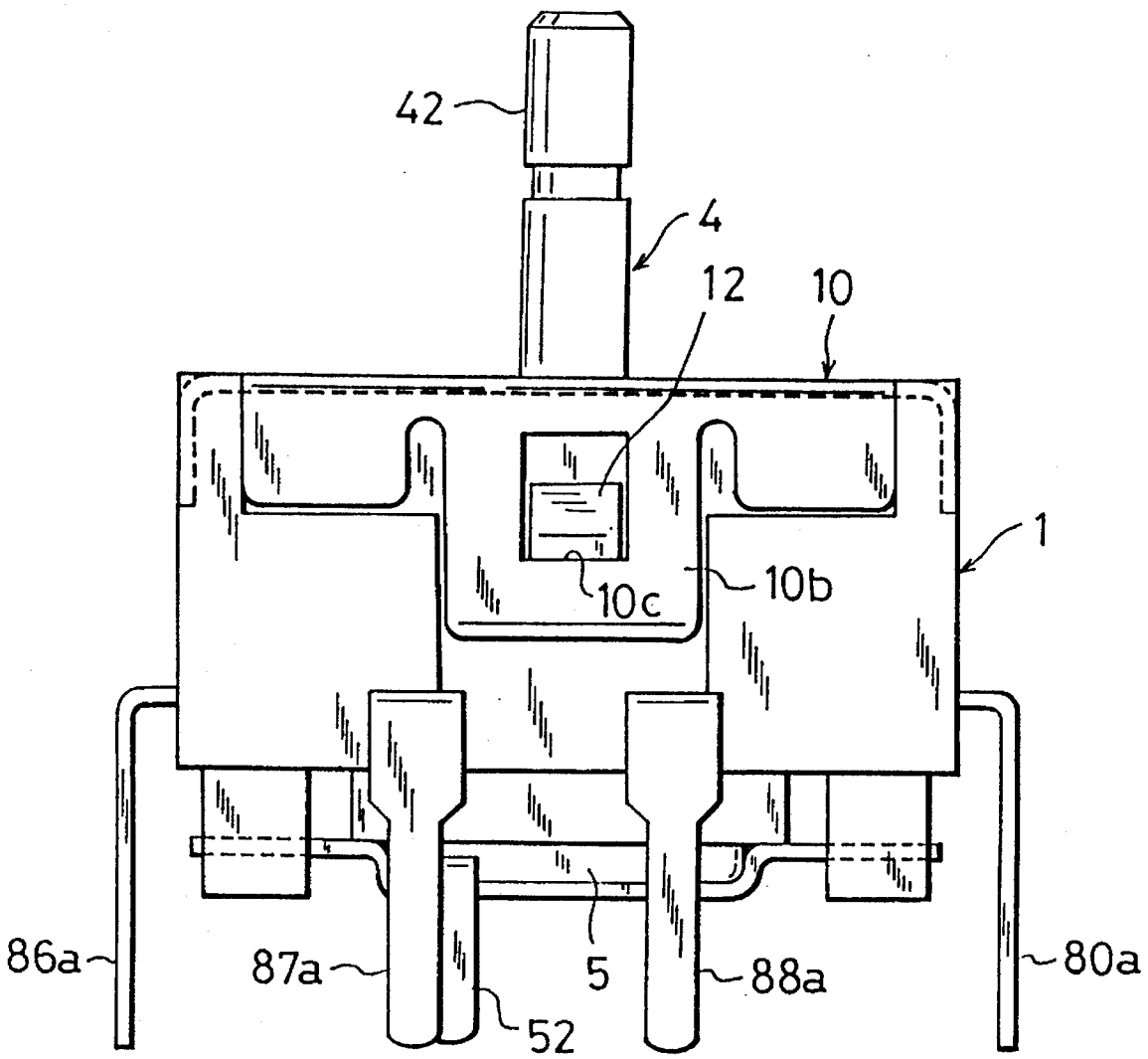
FIG. 5 is a side view of the control switch shown in FIG. 1.

In FIGS. 2, 4 and 5, a box-shaped cover 10 has in the top thereof a circular opening 10*a*. The operating lever 42 passes through this opening 10*a*. The cover 10 has lateral plate portions 10*b* in which engagement holes 10*c* are respectively formed. The lateral plate portions 10*b* engage the box-shaped body 1 and the engagement holes 10*c* are respectively engaged with engagement projections 12 of the box-shape body 1. In this embodiment, the cover 10 is made of a metallic plate subjected to bending or punching. Accordingly, when the cover 10 is fitted onto the box-shaped body 1, the cover 10 does not become bulky. This advantageously makes the control switch a thin and compact design.

According to the control switch having the arrangement mentioned above, when the movable body 7 is set at the neutral position on the base 2 as shown in FIGS. 1, 2 and 4, one contact 121 of the first movable contact-piece member 100 comes in contact with the electric insulating portion 81 of the first terminal member 8 at the center portion thereof, and the other contact 131 comes in contact with the electric insulating portion 80 of the first common terminal 8A, as shown in FIG. 6. Also as shown in FIG. 6, one contact 221 of the second movable contact-piece member 200 comes in contact with the electric insulating portion 91 of the second terminal member 9 at the center portion thereof, and the other contact 231 comes in contact with the electric insulating portion 90 of the second common terminal 9A. Accordingly, when the movable body 7 is set at the neutral position, the first common terminal 8A and the second common terminal 9A are maintained as electrically non-conductive with respect to the terminals of the first and second terminal members 8, 9. Such a non-conduction state is maintained by the fact that the contact 121 comes in contact with the electric insulating portion 81 of the first terminal member 8 and that the contact 221 comes in contact with the electric insulating portion 91 of the second terminal member 9. Accordingly, the electric insulating portions 80, 90 of the first and second common terminals 8A, 9A are disposed such that the first and second common terminals 8A, 9A have electric insulating portions 80, 90, respectively, in contact with contacts 131 and 231, respectively, thereby improving the reliability of maintaining the non-conduction state.

When the operating lever 42 is swung to slide the movable body 7 in a direction away from the neutral position, for example, in the upward direction on the drawing plane of FIG. 1, the contact 121 and the contact 131 of the first movable contact-piece member 100 come in contact with the terminal 89 of the first terminal member 8 and the first common terminal 8A, respectively, as shown in FIG. 7. Accordingly, the first common terminal 8A and the terminal 89 of the first terminal member 8 are electrically connected with each other by the first movable contact-piece member 100. However, the contact 221 of the second movable contact-piece member 200 comes in contact with the electric insulating portion 95 of the second terminal member 9. Accordingly, the second common terminal 9A is maintained as non-conductive with respect to the terminals 86 to 89 of the second terminal member 9. Accordingly, when the movable body 7 is slid vertically or transversely on the drawing plane of FIG. 1, the contact 121 of the first movable contact-piece member 100 comes in contact with one of the four terminals 86 to 89 of the first terminal member 8, the other contact 131 comes in contact with the first common terminal 8A, and the contact 221 of the second movable contact-piece member 200 comes in contact with one of the four electric insulating portions 92 to 95 of the second terminal member 9.

When the movable body 7 is slid in an diagonal direction, e.g., in an upward-rightward direction on the drawing plane of FIG. 1, the contact 221 and the other contact 231 of the second movable contact-piece member 200 come in contact with the terminal 98 of the second terminal member 9 and the second common terminal 9A, respectively, as shown in FIG. 8. Accordingly, the second common terminal 9A and the terminal 98 of the second terminal member 9 are electrically connected with each other by the second movable contact-piece member 200. However, the contact 121 of the first movable contact-piece member 100 comes in contact with the electric insulating portion 85 of the first terminal member 8. Accordingly, the first common terminal 8A is maintained as non-conductive with respect to the terminals 86 to 89 of the first terminal member 8. Accordingly, when the movable body 7 is slid in a diagonal direction on the drawing plane of FIG. 1, the contact 221 of the second movable contact-piece member 200 comes in contact with one of the four terminals 96 to 99 of the second terminal member 9, the other contact 231 comes in contact with the second common terminal 9A, and the contact 121 of the first movable contact-piece member 100 comes in contact with one of the four electric insulating portions 82 to 85 of the first terminal member 8.

Accordingly, (i) the pair of terminals 86, 88 of the first terminal member 8 which are opposite to each other in the transverse direction, may be used for providing conduction states in the X-axis direction at the positive and negative sides, (ii) the pair of terminals 87, 89 opposite to each other in the vertical direction may be used for providing conduction states in the Y-axis direction at the positive and negative sides, (iii) the pair comprising the lower left terminal 96 and the upper right terminal 98 of the second terminal member 9 may be used for providing conduction states in the upward-rightward diagonal direction at the positive and negative sides, and (iv) the pair comprising the upper left terminal 99 and the lower right terminal 97 may be used for providing conduction states in the downward-rightward diagonal direction at the positive and negative sides. Thus, there can be obtained eight different conduction states.

When the operating lever 42 is turned along the periphery of the circular opening 10*a* in the cover 10, the contact 121 of the first movable contact-piece member 100 and the contact 221 of the second movable contact-piece member 200 are turned along a circular path of rotation 100*a*, 200*a*, respectively, shown in FIGS. 7 and 8, and successively come in contact with the terminals 86 to 89 and the terminals 96 to 99, respectively. At this time, the other contact 131 of the first movable contact-piece member 100 and the other contact 231 of the second movable contact-piece member 200 are turned along a circular path of rotation 100A, 200A, respectively, shown in FIGS. 7 and 8, while the other contacts 131 and 231 remain in contact with the first common terminal 8A and the second common terminal 9A, respectively. Accordingly, the eight different conduction states mentioned above can be successively switched. Since the opening 10*a* in the cover 10 is circular, the operating lever 42 can be smoothly turned. Further, the transversely projecting portion 45 of the spherical body 41 in the operating mechanism 4 is engaged with the engagement hole portion 35 in the holding body 3. This prevents each of the operating lever 42 and the spherical body 41 from being rotated on its own axis in the holding body 3. Accordingly, a variety of conduction states in the X-axis, Y-axis and diagonal directions can be effected by the operating lever 42.

When the operating lever 42 is pushed down to push down the spherical body 41 inside of the holding body 3, the pushbutton 51 of the switch 5 is pushed by the projecting portion 43 of the spherical body 41. This causes the switch 5 to be turned on. When the operating lever pushing forcing is released, the switch 5 is turned off.

The control switch having the arrangement mentioned above may be used as a controller in a navigation system for a motor vehicle. In such a case, when the operating lever 42 is swung or turned, a point indicated by a cursor on a monitor is moved vertically, transversely or diagonally. At the time when the point is moved to a desired position, the operating lever 42 can be pushed down. This causes the switch 5 to be turned on, so that the point position can be set.

In this embodiment, each of the first terminal member 8 and the second terminal member 9 has four terminals. Within the scope of the present invention, the number of the terminals in each of the first and second terminal members 8, 9 may be three, two or greater than four. Further, the operating mechanism 4 which is of the lever type in the embodiment, may be so arranged as to be of the type using a slide knob.

What is claimed is:

1. A control switch comprising:

a base;

a movable body disposed on said base to slide thereon in all directions and normally biased toward a position on said base defining a neutral position;

an operating mechanism mounted to said base and engageable with said movable body for sliding said movable body in all directions;

a first terminal member disposed on the surface of said base and having a first terminal pattern which defines (i) an electric insulating portion at the center portion of said first terminal member, (ii) a plurality of electric insulating portions around said first terminal member center portion at regular angular intervals, and (iii) a plurality of terminals divided by said electric insulating portions;

a second terminal member disposed on the surface of said base and having a second terminal pattern which defines (i) an electric insulating portion at the center portion of said second terminal member, (ii) a plurality of electric insulating portions around said second terminal member center portion at regular angular intervals and (iii) a plurality of terminals divided by said electric insulating portions, said second terminal pattern being different in phase from said terminal pattern of said first terminal member;

a first common terminal disposed on the surface of said base, said first common terminal being associated with said first terminal member;

a second common terminal disposed on the surface of said base, said second common terminal being associated with said second terminal member;

a first movable contact-piece member set at (i) a position where said first movable contact-piece member extends over said electric insulating portion of said first terminal member at said center portion thereof and said first common terminal when said movable body is set to said neutral position, and (ii) a position where said first movable contact-piece member extends over one of said terminals of said first terminal member and said first common terminal when said movable body is slid in a direction away from said neutral position; and a second movable contact-piece member set at (i) a position where said second movable contact-piece member extends over said electric insulating portion of said second terminal member at said center portion thereof and said second common terminal when said movable body is set to said neutral position, and (ii) a position where said second movable contact-piece member extends over one of said terminals of said second terminal member and said second common terminal when said movable body is slid in a direction away from said neutral position.

2. A control switch according to claim 1, further comprising:

resilient members, and wherein said movable body is normally biased to said neutral position of said base by the biasing forces of said resilient members.

3. A control switch according to claim 2, further comprising:

spring receiving pieces, wherein said base is formed by the bottom wall of a box-shaped body and is square in plan elevation, the movable body is square in plan elevation, and said resilient members and said spring receiving pieces are disposed between (i) the four sides of said movable body disposed on said base inside of said box-shaped body and (ii) the four lateral walls of said box-shaped body which respectively extend from the four sides of said base, said resilient members comprising compression coiled springs, said spring receiving pieces slidably coming in contact with said lateral walls of said box-shaped body.

4. A control switch according to claim 1, wherein the first and second movable contact-piece members are disposed on the base and adjacent to the movable body.

5. A control switch according to claim 1, wherein the neutral position of the movable body on the base refers to the center position of said base.

6. A control switch according to claim 1, wherein the terminal pattern of the first terminal member includes (i) an electric insulating portion disposed at the center portion of said first terminal member, (ii) four electric insulating portions disposed around said center portion at regular angular intervals of 90° and (iii) four terminals divided by said four electric insulating portions of said first terminal member, and the terminal pattern of the second terminal member includes (i) an electric insulating portion disposed at the center portion of said second terminal member, (ii) four electric insulating portions disposed around said center portion at regular angular intervals of 90° and (iii) four terminals divided by said four electric insulating portions of said second terminal member.

7. A control switch according to claim 1, wherein the first terminal pattern of the first terminal member is different in phase by 45° from the second terminal pattern of the second terminal member.

8. A control switch according to claim 7, wherein each of the first and second common terminals is provided at one portion thereof with an electric insulating portion.

9. A control switch according to claim 1, further comprising: a switch having an actuator, and wherein said base includes a case-like holding body disposed at the center portion of said base, the operating mechanism has a spherical body and an operating lever projecting from said spherical body, said spherical body is held by said case-like holding body such that said spherical body is rotatable and displaceable in the axial direction of said case-like holding body, and said spherical body operates the actuator of said switch when said spherical body is displaced in the axial direction of said case-like holding body.

10. A control switch according to claim 9, wherein the spherical body of the operating mechanism is fitted in the case-like holding body such that said spherical body is not rotatable on its own axis.

11. A control switch according to claim 9, wherein the spherical body of the operating mechanism has a transversely projecting portion, and said transversely projecting portion is fitted in a slit-like engagement hole formed in the case-like holding body, said slit-like engagement hole extending in the axial direction of said case-like holding body, said transversely projecting portion being slidable only in said axial direction of said case-like holding body.

12. A control switch according to claim 9, wherein a cover engages the box-shaped body, said cover having a circular opening through which the operating lever of the operating mechanism passes.

* * * * *